US005481878A

United States Patent [19]

Shaowei

[11] Patent Number: 5,481,878

[45] Date of Patent: Jan. 9, 1996

[54] PULSE TUBE REFRIGERATOR

[75] Inventor: Zhu Shaowei, Xixia county, China

[73] Assignee: Daido Hoxan Inc., Sapporo, Japan

[21] Appl. No.: 243,487

[22] Filed: May 16, 1994

[30] Foreign Application Priority Data

May 16, 1993 [CN] China ..... 93105608
Jul. 25, 1993 [CN] China ..... 93109175

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,166,911 | 1/1965 | Meijer . | |
| 3,220,201 | 11/1965 | Heuchling et al. | 62/6 |
| 3,314,244 | 4/1967 | Green | 62/6 |
| 3,487,424 | 12/1969 | Andre et al. . | |
| 3,645,649 | 2/1972 | Beale | 62/6 |
| 3,877,239 | 4/1975 | Leo . | |
| 4,926,639 | 5/1990 | Mitchell et al. . | |
| 4,987,743 | 1/1991 | Lobb . | |
| 5,107,683 | 4/1992 | Chan et al. . | |

FOREIGN PATENT DOCUMENTS 0218554 4/1987 European Pat. Off. .

OTHER PUBLICATIONS

Proceedings of Third Japanese–Sino Joint Seminar, Oct. 23–27, 1989 on Small Small Refrigerators & Related Topics, pp. 154–159.

Phillips Laboratory—Directorate of Space and Missiles Technology Conference Proceeding, Apr. 1993 Part 1 of 4, pp. 166–186.

Cryogenics 1992, 32:24–27, Zhou et al., *Experimental Results of the Internal Process of a Double Inlet Pulse Tube Refrigerator.*

*Primary Examiner*—Ronald C. Capossela
*Attorney, Agent, or Firm*—Armstrong, Westerman, Hattori, McLeland & Naughton

[57] ABSTRACT

A high pressure valve and low pressure valve are positioned at a hot end of the pulse tube and two direction valves are positioned respectively between the high pressure reservoir, the low pressure reservoir and the pulse tube. In the pulse tube refrigerator wherein the cold is produced by time-phase displacement with orifice, an irreversible loss is caused when the gas passes through the orifice. However, the refrigeration in this invention comprising high and low pressure reservoirs, and open and close valves, all the energy can be converted without loss in adiabatic expansion of the gas in the pulse tube, theoretical efficiency is 100%.

7 Claims, 7 Drawing Sheets

PULSE TUBE REFRIGERATOR

BACKGROUND OF THE INVENTION

1. Field of the Invention

This invention relates to a gas refrigerator, especially to a pulse tube refrigerator.

2. Description of the Related Art

In order to produce cold temperature in a pulse tube by gas expansion, it is necessary to cause time-phase displacement in the pressure of vibrating gas and the change of gas volume. Therefore, an orifice type pulse tube refrigerator, as is known in the art, includes mainly a high pressure gas inlet valve, a low pressure gas outlet valve, a regenerator, a cooler, a refrigeration power heat exchanger, a gas smoother, an orifice, which forms phase displacement, and a reservoir system. Such an orifice and a reservoir system are connected to a hot end of a pulse tube thereof. The expansion work is released as heat to the outside by the throttling process of the orifice, which provides the pulse tube with a refrigeration effect. If such a irreversible loss is not produced at the hot end of the pulse tube, the pulse tube does not generate the refrigeration effect. However, the gross refrigeration power per unit mass flow in the pulse tube is very low, which causes theoretically very low efficiency. This is because there is an non-constant pressure gas inlet process when the high pressure gas inlet valve is opened, which is an irreversible process. On the other hand, there is non-constant pressure gas outlet process when the low pressure gas outlet valve is opened, which is also an irreversible process. This necessarily causes a large irreversible loss. These two processes cause theoretically very low efficiency of the orifice type pulse tube refrigerator. That is, the efficiency is poor in such a pulse tube refrigerator as produces cold by forming phase displacement with orifice because irreversible loss occurs when gas passes through the orifice. However, a theoretical efficiency in a perfect cycle reaches 100%. When the pulse tube refrigerator is used in case of a small refrigeration power, this disadvantage is not obvious. However, in case for necessity of large refrigeration power, this disadvantage becomes very conspicuous.

SUMMARY OF THE INVENTION

The object of this invention is to avoid the irreversible loss occuring in the gas inlet or outlet process when a high pressure gas inlet valve or a low pressure outlet gas valve opens, thereby achieving an isotropic process, and getting the largest temperature decrease and maximum refrigeration power, and increasing the theoretical refrigeration efficiency of pulse tube refrigerator.

The above object of this invention is obtained by providing a high pressure reservoir and a low pressure reservoir at the hot end of the pulse tube and two direction valves between the reservoirs and the pulse tube respectively.

When the pressure ratio of the pulse tube is too high, it is needed to add several pressure reservoirs different in pressure other than high pressure reservoir and low pressure reservoir, wherein a two directional valve is provided between the middle pressure reservoirs and the hot end of pulse tube.

The present invention is now described in further detail.

DETAILED DESCRIPTION OF THE PREFERRED EMBODIMENTS

Figure 1:
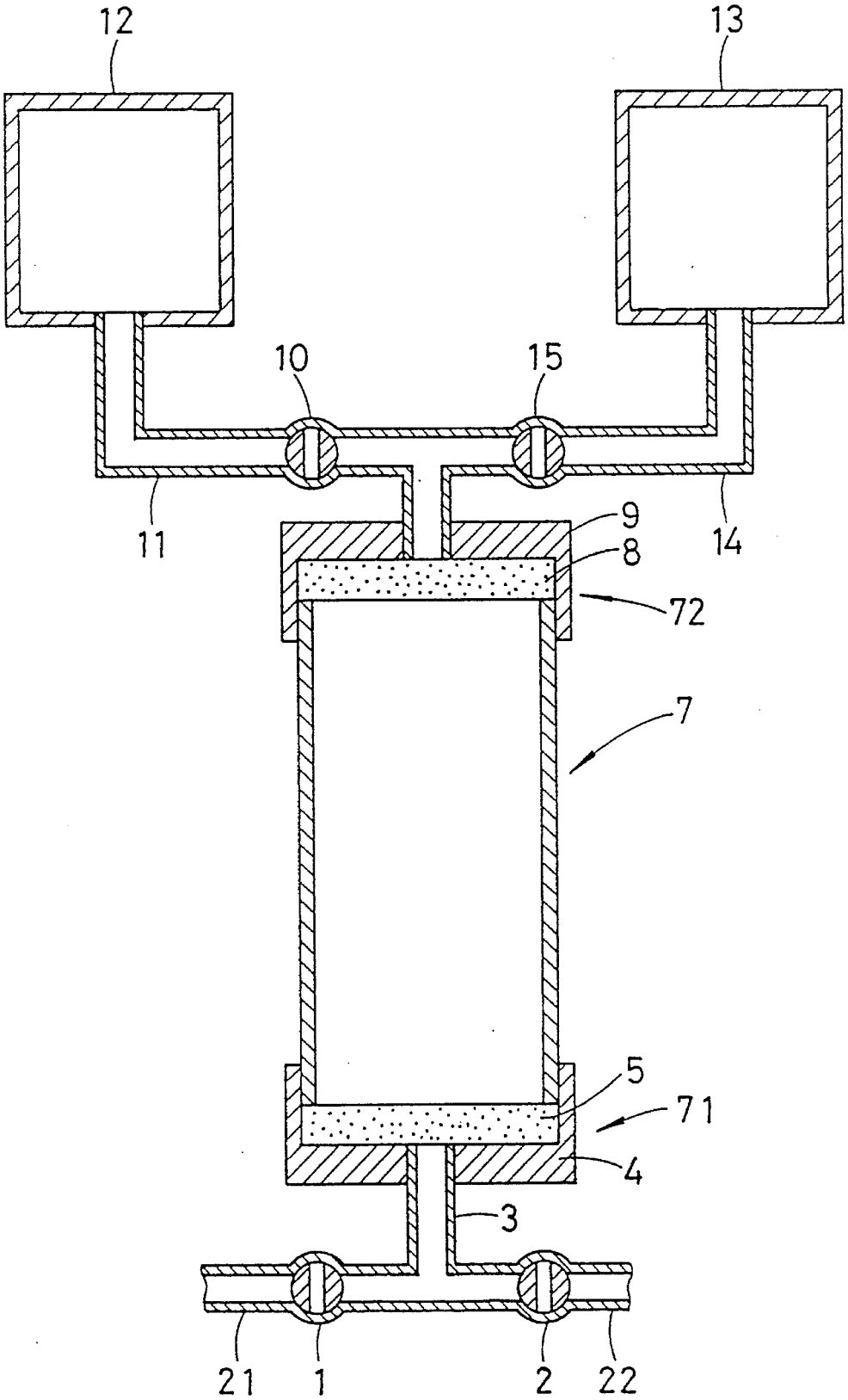
FIG. 1 is a vertical sectional view of one structure in one example of the pulse tube refrigerator with high pressure reservoir and low pressure reservoir.

As shown in FIG. 1, in a preferred exemplary embodiment of the invention, a cover 4 and a gas smoother 5 are installed at a cold end 71 (at a side near to inlet/outlet valve) of a pulse tube 7. A high pressure gas inlet valve 1 and a low pressure gas outlet valve 2 are connected to a above cold end 71 via an inlet gas tube 21 connected to a high pressure gas source (not shown) and an outlet gas tube 22 connected to a low pressure gas source (not shown), further through a sum up tube 3. Gas inlet and outlet are usually switched by employing a rotating valve, however, separated type valves are adopted as the valves 1 and 2 on the inlet tube and the outlet tube to make the working process more easily understood. There are a cover 9, a gas smoother 8 at a hot end 72 of the pulse tube 7. In FIG. 1, a high pressure reservoir (a buffer tank) 12 and a low pressure reservoir (a buffer tank) 13 are installed on the hot end of the pulse tube 7, a high pressure reservoir valve 10 is installed in a joint tube 11 between the high pressure reservoir 12 and the hot end of pulse tube, a low pressure reservoir valve 15 is installed on a joint tube 14 between the low pressure reservoir 13 and the hot end of pulse tube. Here, the high pressure reservoir valve 10 and low pressure reservoir valve 15 are separated, and can be replaced by a single rotary valve. In FIG. 1, the pressure in the high pressure reservoir and low pressure reservoir are almost equal with those of the high pressure gas source and low pressure gas source respectively.

Joint tubes 11, 14 and valves installed thereon in FIG. 1 have a cooling effect. The high and low pressure reservoir valves 10 and 15 are separate types, however, they may be replaced with a two position three pass type valve. The type of the valve can also be an electric operated valve, electromagnetic valve, pneumatic valve, rotary valve and so on.

The working process of the pulse tube with high pressure reservoir and low pressure reservoir 12, 13 is as follows:

(1) The inlet gas valve 1 and the outlet gas valve 2 are closed and the low pressure reservoir valve 15 is also closed.

Figure 3:
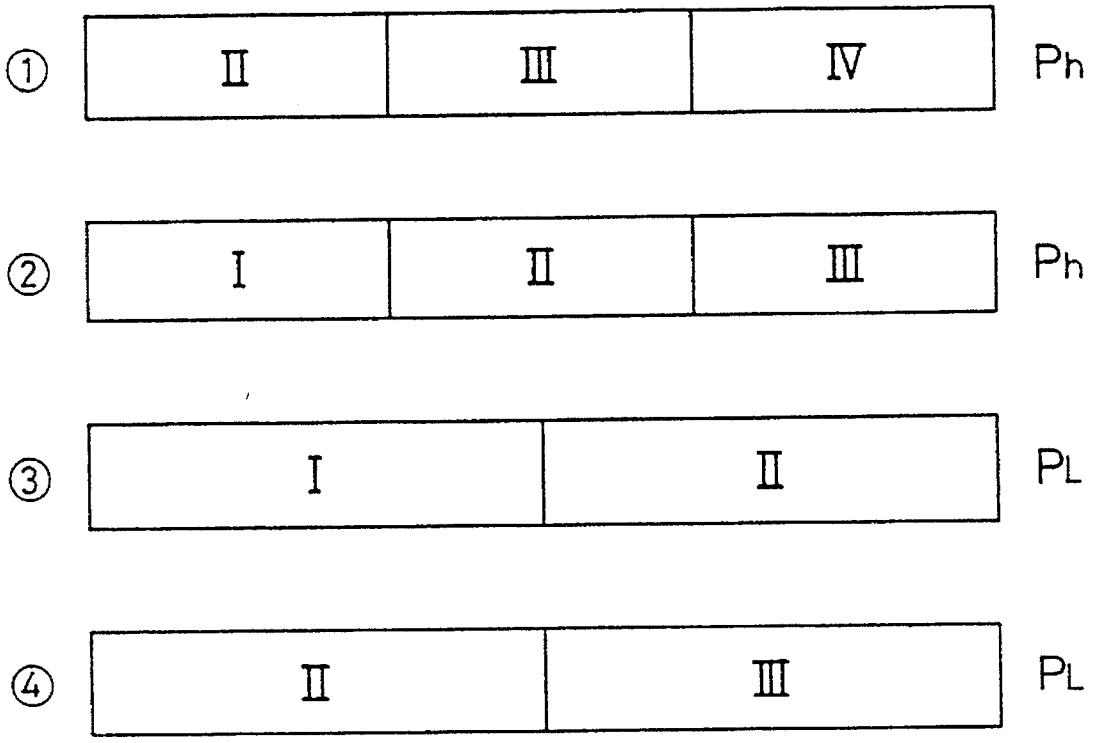
FIG. 3 is the gas distribution figure in the pulse tube with high pressure reservoir in FIG. 1, low pressure reservoir when it works.

At that time, the pressure in the pulse tube 7 is the same as the pressure of the low pressure gas source. When the high pressure reservoir valve 10 is opened, high pressure gas flows from the high pressure reservoir 12 to the hot end of the pulse tube 7, which increases the pressure in the pulse tube 7 near to the pressure of high pressure reservoir. Such a condition of the pulse tube is shown in FIG. 3-1. In the figure, IV is a high pressure gas introduced from the high pressure reservoir, and II and III are the gas in the pulse tube 7, wherein low pressure is changed into high pressure. Ph indicates high pressure in the pulse tube.

Figure 2:
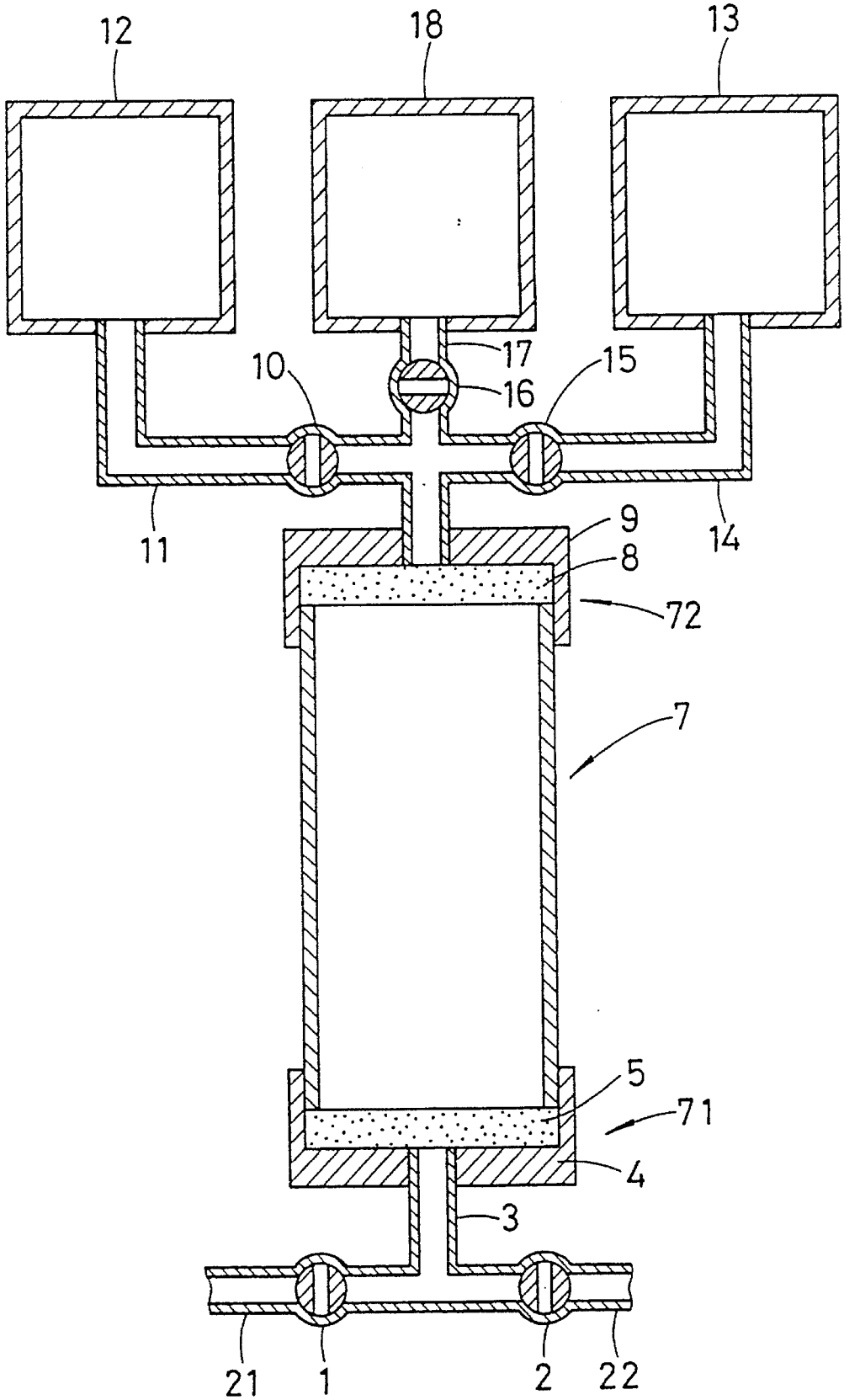
FIG. 2 is a vertical sectional view of the pulse tube refrigerator in another example with high pressure reservoir, middle pressure reservoir and low pressure reservoir.

(2) In a state in which the valve 10 is opened, the inlet gas valve 1 is opened. The status of the other valves remains unchanged, the high pressure gas flows into the cold end of the pulse tube 7 through the inlet gas valve 1. Since the pressure of the high pressure gas source is slightly higher than the pressure of high pressure reservoir, the gas IV in the high pressure reservoir (see FIG. 3-1), which just flowed into the pulse tube 7 from high pressure reservoir 12 in the above process (1), is returned to the high pressure reservoir. This process is basically a constant pressure gas inlet process. The distribution of high pressure gas is shown in FIG. 3-2. I of FIG. 3-2 indicates the high pressure gas introduced from the high pressure gas source into the pulse tube 7.

(3) When the high pressure reservoir valve 10 and the inlet gas valve 1 are closed, and outlet gas valve 2 remains closed, then the low pressure reservoir valve 15 is opened, the gas III (see FIG. 3-3) of the pulse tube 7 flows into the low pressure gas reservoir 13. As a result the pressure in the pulse tube 7 decreases to that of the low pressure reservoir 13. The high pressure gas I, which flows together with the gas II into the pulse tube 7, expands to the pressure of the low pressure gas reservoir 13 and its temperature falls so as to cool the cold end 71 of the pulse tube 7. The gas distribution is shown in FIG. 3-3.

(4) When the low pressure gas outlet valve 2 is opened, the status of the other valves remains unchanged. The gas I, which expands in the pulse tube 7 in the above process (3), is withdrawn via an outlet gas valve 2 (see FIG. 3-4), and then the low pressure gas of the low pressure reservoir 13 flows into the hot end of the pulse tube 7 so that the pressure returns to the low pressure.

As shown in FIGS. 3-1, 3-2, 3-3 and 3-4, the gas in the pulse tube can be divided into gas bulk I which flows from the high pressure gas source, gas bulk II which functions as a gas piston, gas bulk III which is introduced from the low pressure reservoir, and gas bulk IV which is introduced from the high pressure reservoir.

The line up from left to right, and can flow into or flow out of the pulse tube 7 in accordance with the working process. In the initial status of the process, shown in FIG. 3-4, the gas bulk II and III exist in the pulse tube 7. After the process (1), the gas bulk IV flows into the pulse tube 7, resulting in the increase of the pressure in the pulse tube 7 to Ph. After the above process (2), the gas bulk I, which flows from the high pressure gas source, pushes the gas bulk IV out of the pulse tube 7, wherein the pressure in the pulse tube 7 still remains Ph. In process (3), the gas bulk III flows from the low pressure reservoir remains into the low pressure reservoir, wherein the pressure in pulse tube 7 becomes P1. In the process (4), the gas bulk I, which flows from the high pressure gas source, is pushed out of the pulse tube 7. At this stage, one working period has been finished.

Once one cycle has been finished, another cycle starts from the initial state. The pulse tube 7 works periodically, the high pressure gas is expanded continuously so as to get into low pressure. If we do not consider loss through the heat transfer, gas mixing and flow in the pulse tube 7, the pressure in the high pressure reservoir 12 is equal to that of high pressure gas source, the pressure in the low pressure reservoir is 13 equal to that of the low pressure gas source.

The gas inlet process and gas outlet process in the above pulse tube 7 is isotropic, so that the efficiency has isoentropic efficiency. The expansion work given by the refrigeration gas (high pressure gas) is converted into heat by the irreversible discharge of gas from the reservoir to the pulse tube 7 and from the pulse tube to the reservoir, and discharged to the outside.

Namely, when one cycle has finished, as explained above, the gas I enters the pulse tube 7 from the high pressure gas source, produced cold temperatures by an adiabatic expansion, and finally is exhausted into the low pressure source. The gas II stays in the pulse tube 7 so as to function as a gas piston, while the gases III and IV just go back and forth.

The inlet and outlet of the gas is performed reversibly without loss and the gas I expands, resulting in a theoretical efficiency of 100%. Actually, the gas pressure difference between before and after passing through a valve cannot be zero so that 100% is impossible. However, compared with an orifice type, the loss in the pulse tube refrigerator in this invention is theoretically low.

EXAMPLE 2

When the pressure ratio of inlet and outlet gas is too high, the length of gas bulk IV in process (1), as shown in FIG. 3-1, extends greatly, the length of high pressure gas bulk I which flows from high pressure gas source in process (2) also extends greatly. After process (3), part of the expanded high pressure gas bulk I flows into the low pressure reservoir. However, due to a room temperature in the low pressure reservoir, sufficient refrigerating effect cannot be obtained in the working process. Therefore, one or a plural middle pressure reservoirs, different in pressure, have to be installed to overcome this disadvantage. In other words, if the pressure ratio of the high and low pressure is increased, for example, the time required to fill the gas from the high pressure gas tank into the low pressure tube, it actually ends up with an increase in loss. Then, the middle pressure tank 18 and the valve 17 are added, as shown in FIG. 2, that is, the outlet/inlet through the middle pressure gas is added into one cycle, so that the time for each gas to go in and out can be shortened. As a result, the gas piston functions ideally so that the loss is minimized.

FIG. 2 is a vertical sectional view of the pulse tube refrigerator of another embodiment with high, middle and low pressure reservoirs. In the FIG. 2, a middle pressure reservoir 18 is added to the original high pressure reservoir 12 and low pressure reservoir 13. The pressure in the middle pressure reservoir 18 is set between the pressure of high pressure reservoir and low pressure reservoir, a joint tube 17 and a valve 16 are positioned between the middle pressure reservoir 18 and the hot end of the pulse tube 7.

The working process of this refrigerator is as follows:

(1) The inlet valve 1, the outlet valve 2, the low pressure valve 15, and the high pressure reservoir 10 are closed, while the middle pressure reservoir valve 16 is opened. The gas flows into the hot end of pulse tube 7 from the middle pressure reservoir 18 through the middle pressure reservoir valve 16. The pressure in the pulse tube is increased to the pressure of middle pressure reservoir.

(2) The middle pressure reservoir valve 16 is closed, the high pressure reservoir valve 10 is opened and the status of the other valves remain unchanged. In this process, the gas in the high pressure reservoir 12 flows through the high pressure reservoir valve 10 into the hot end of the pulse tube. The pressure in the pulse tube is increased to the pressure of the high pressure reservoir.

(3) The inlet gas valve 1 is opened and the status of the other valves remain unchanged. In the gas of the high pressure gas source flows through inlet valve 1 into the cold end (the low temperature side) of the pulse tube. The gas which flows into the pulse tube 7 from the high pressure gas reservoir 12 returns to the high pressure reservoir through valve 10.

(4) The inlet valve 1 and the high pressure reservoir valve 10 is closed while the middle pressure reservoir valve 16 are opened. The status of the other valves remains unchanged. The gas which flows into the pulse tube in the above process (1) from the middle pressure reservoir 18 returns to the middle pressure reservoir 18 through valve 16. As a result, the pressure in the pulse tube is decreased to the pressure of the middle pressure reservoir 18. Also, the gas which flows into the cold end of pulse tube from high pressure gas source in the above process (3) is expanded to the pressure of the middle pressure reservoir 18, its temperature falls.

(5) The middle pressure reservoir valve 16 is closed, the low pressure reservoir valve 15 is opened and the status of other valves remains unchanged, the gas in the hot end of pulse tube flows into the low pressure reservoir 13. As a result, the pressure in the pulse tube 7 is decreased to the pressure of the low pressure reservoir 13. Therefore, the gas which flows into the cold end of the pulse tube from the high pressure gas source in process (3) is expanded further to the pressure of the low pressure reservoir. As a result, the temperature is decreased further.

(6) The outlet gas valve 2 is opened and the status of the other valve remains unchanged. The gas flows into the hot end of the pulse tube from the low pressure reservoir 13 through low pressure reservoir valve 15, and push out the gas which flows into the cold end of the pulse tube from the high pressure gas source in process (3) from the pulse tube through outlet gas valve 2. At this stage, it returns to the initial condition. That is, the working process of one cycle has been finished.

The pulse tube refrigerator periodically works like this, the gas in the high pressure gas source continuously expands so as to function as a exhaust pressure. If the loss caused by the flow friction, heat transfer and the gas mixing in the pulse tube is not considered, all the process is isoentropic process. Since the gas distribution in a bar graph is similar to the above graph, such a graph is not given here.

The working process of a pulse tube refrigerator with a plurality of reservoirs is described by using an example of the pulse tube refrigerator with the high, middle and low pressure reservoirs.

When the pressure is still high enough as in the embodiment described above, several different pressure reservoirs can be installed other than the high pressure reservoir and low pressure reservoir, if necessary. Since the principle is basically similar, as above mentioned, such a case is also included in this invention.

The separated type valves, as shown in the figures, are used here, however, it is preferable to employ multi-position multi-pass electric operated rotary valve because such a valve has the effect of several valve to control multiple tubes. Furthermore, it is easier to control and the structure is simpler.

Figure 4:
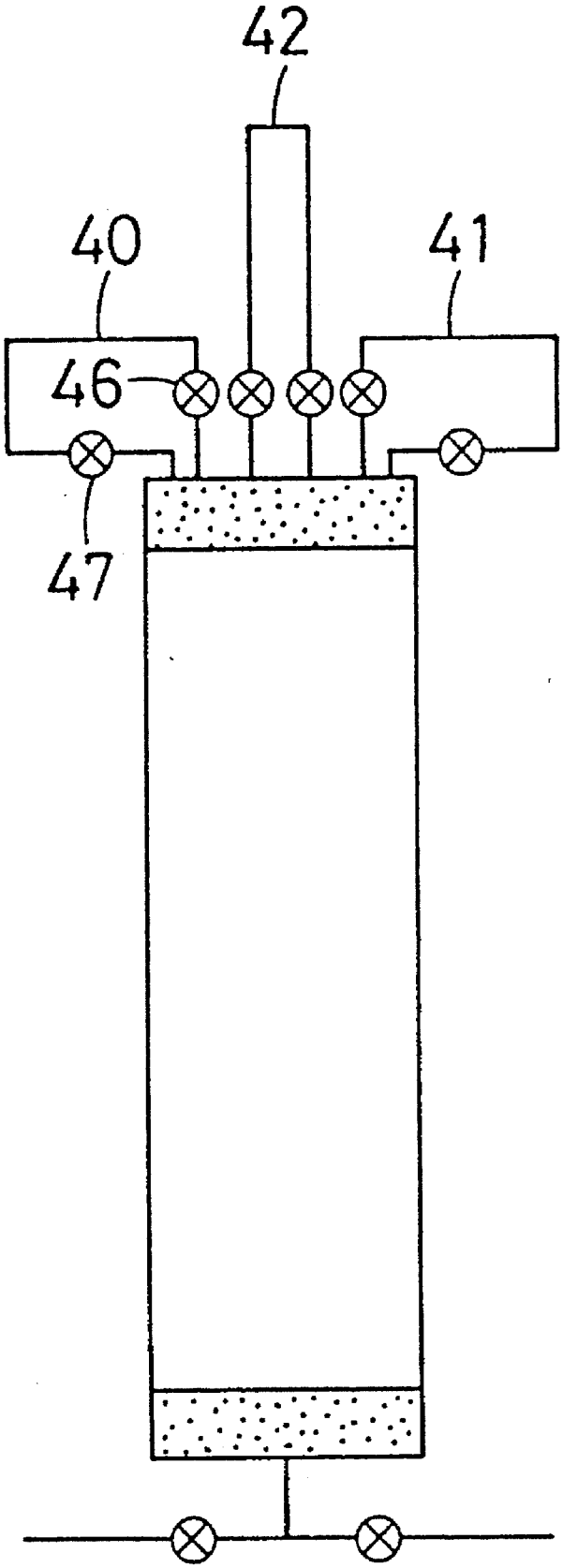
FIG. 4 is the structure of still another example in which the reservoir is replaced with the tube.

As shown in FIG. 4 in a third embodiment of the invention, the reservoirs 12, 13 and 18 and the joint tubes can be replaced with long tubes 40, 41 and 42 respectively, which connect with the hot end of the pulse tube. Check valves 46 and 47 are separately installed at the two ends of the tube. This allows the gas in the tube flow in one direction so that the tube has the effect of a reservoir and the effect as a cooler.

Figure 5:
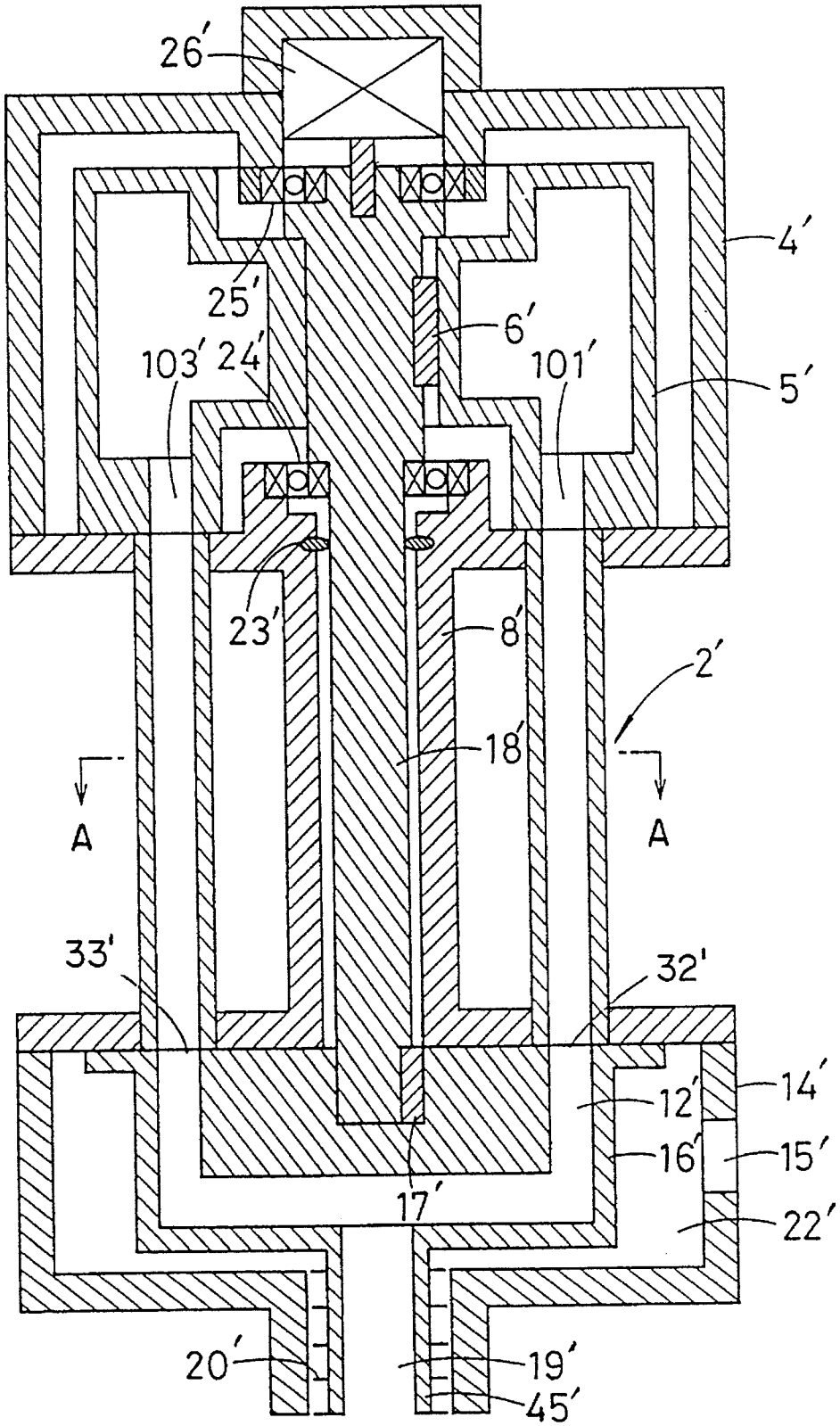
FIG. 5 is a sectional view of multi-reservoir pulse tube refrigerator.

FIG. 5 shows a fourth embodiment of the present invention, wherein plural pulse tubes are arranged circularly and open and close valves are composed of rotary valves 5', 16'. In this embodiment, valves 5', 16' at the cold and hot end can be opened and closed by the rotation of a motor. Namely, a large amount of flow can be realized by installing plural pulse tubes with the apparatus being compact.

Figure 6:
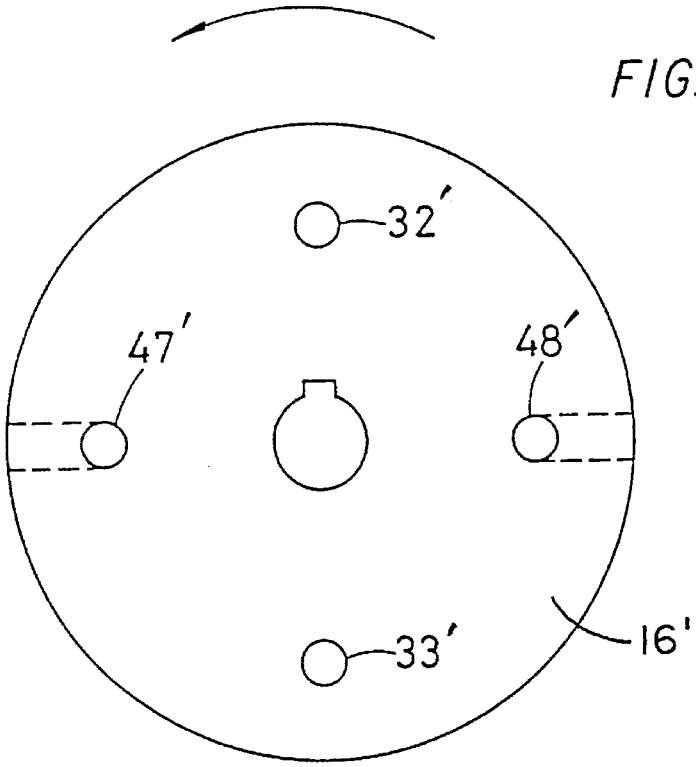
FIG. 6 shows the holes on the slide surface of rotary valve core.
Figure 8:
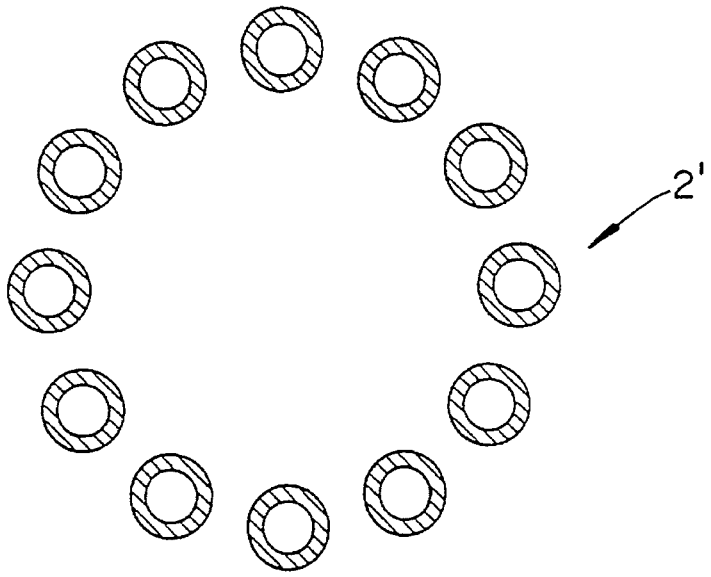
FIG. 8 is a A—A sectional view taken along the line.

More particularly, a series of pulse tubes 2' are installed under the thread wheel like pulse tube frame 8'. The pulse tubes are at the same circumference whose center is shaft 18'. The sectional view of pulse tubes is shown in FIG. 8. The upper end face of the pulse tube frame 8' contacts closely, however slidably, the lower end face of rotary reservoir 5'. The inside of the rotary reservoir 5' is divided into two high pressure reservoirs, two middle pressure reservoirs and two low pressure reservoirs. Each reservoir in the same pressure is positioned almost symmetrically about the axis and is connected each other via pipe. There are holes of each reservoir on the slide end surface of rotary reservoir 5' such as holes 101', 102', 103'. . . 294' in FIG. 5. In detail, the arrangement order of the holes of the high, middle, low pressure reservoir are successively; middle pressure reservoir outlet hole 281, high pressure reservoir hole 102', high pressure reservoir inlet hole 101', middle pressure inlet hole 284', low pressure reservoir inlet hole 294', low pressure reservoir outlet hole 293', middle pressure outlet hole 283', high pressure outlet hole 104', high pressure reservoir inlet hole 103', middle pressure reservoir inlet hole 282', low pressure reservoir inlet hole 292', low pressure outlet hole 291'. The revolution direction is shown as an arrow. These holes and the hot end of the pulse tube are at the same circumference. When working, the holes of each reservoir and the hot end of pulse tubes relatively turn, and are connected successively. When holes are face to face with pulse tubes 2, valves open, while when they turn away, valves close. In FIG. 5, the pulse tube frame 18' is fixed, and do not move. The rotary reservoir 5' is connected to the center shaft 18' which passes through the pulse tube frame 8' via the key 6'. The lower end face of pulse tube frame 8' and the upper end face of gas inlet and outlet rotary valve core 16' contact slidably. This rotary valve core 16' connected integrally to the center shaft 18' which is driven by electric motor 26', via key 17'. Therefore, the rotary reservoir 5' and the rotary valve core 16' turn together in accordance with rotation of shaft 18'. High pressure gas inlet holes 32', 33' and low pressure gas outlet holes 47', 48' are arranged symmetrically about the axis on the face ends of the above valve core 16' as shown in FIG. 6. These holes 32', 33', 47' and 48' rotate toward the low pressure gas inlet holes of a group of pulse tubes and connect successively. The high pressure gas inlet path 12' in the rotation valve core 16' is divided into two at the position of the shaft center hole 19' and connected to the cold end of the pulse tube 2'. The shape of each high pressure gas path 12' is constant cross area. In FIG. 5, the space between the rotary core 16' and the core shell 14' forms the cold chamber 22'. The position of high pressure gas inlet holes 32', 33' and low pressure gas outlet 47', 48' on the end face of the rotary valve core (16') is shown in FIG. 6. They are at the same circumference so as to be located separately with an angle 90° each other. High pressure gas inlet holes 32', 33' and low pressure gas outlet holes 47', 48' can be one hole respectively, arranged separately at an angle of 180° to each other, i.e., in opposite. Low pressure gas outlet passage, shown in FIG. 6 with the dotted line, communicating with low pressure cold chamber 22' through two both side walls and further communicating with the low pressure gas source (not shown) through the hole 15'. In order to avoid the high pressure gas leak to the low pressure-cold chamber 22', there is labylinth seal 20' between the inner empty shaft of the rotary valve 45' and the cold shell 14'. In order to avoid the gas flow between the cold end and the hot end, there is a seal 23' between the shaft 18' and pulse tube frame 8'. On the outer circumference of the rotary gas reservoir 5', a cover 4', which seals gas, is installed on the pulse tube 8'.

Figure 7:
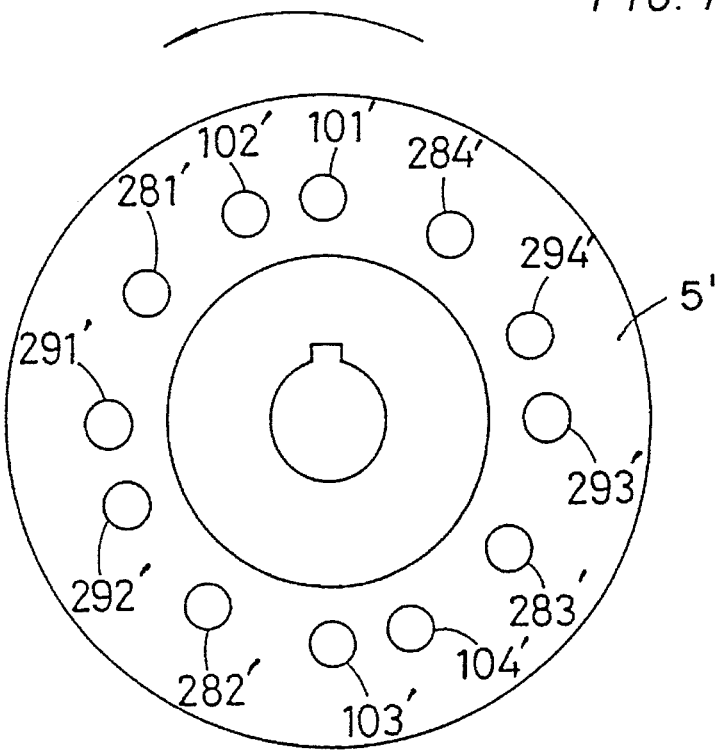
FIG. 7 shows the holes on the slide surface of rotary reservoirs.

Bilateral relationship between each gas reservoir inlet and outlet 101, 102, 103 . . . and 294 and each hole 32, 33, 47 and 48 installed on the rotation valve core 16' is positioned as shown in FIGS. 6 and 7.

The central axis 18' is rotated so that the rotation gas reservoir 5 and the rotation valve core 16' are rotated toward a group of pulse tubes 2'. Then, the gas reservoir inlets and outlets 101, 102, 103 . . . and 294 and the gas holes 32, 33, 47 and 48 are connected one after another so that the high pressure gas is adiabaticaly expanded in the pulse tube 2' to produce cold. This process is considered to be the same process as the process (1) to (6) of the second embodiment from viewing the one pulse tube 2'.

In this example, the rotation gas reservoir 5' and the rotation valve core 16' are rotated toward plural pulse tubes so that the process (1) to (6) can be performed one after another successively, resulting in a large amount production of cold temperatures, even with a small apparatus.

The position on the above mentioned rotary reservoir 5' and rotary valve core 16' is designed by the working process of the pulse tube. There is a certain relationship between them which is easily realizable for a common engineer. When installing, the hole 32' and hole 101' in FIG. 5 has the same phase angle. The holes in FIGS. 6 and 7 finish two cycles in one rotation.

Figure 9:
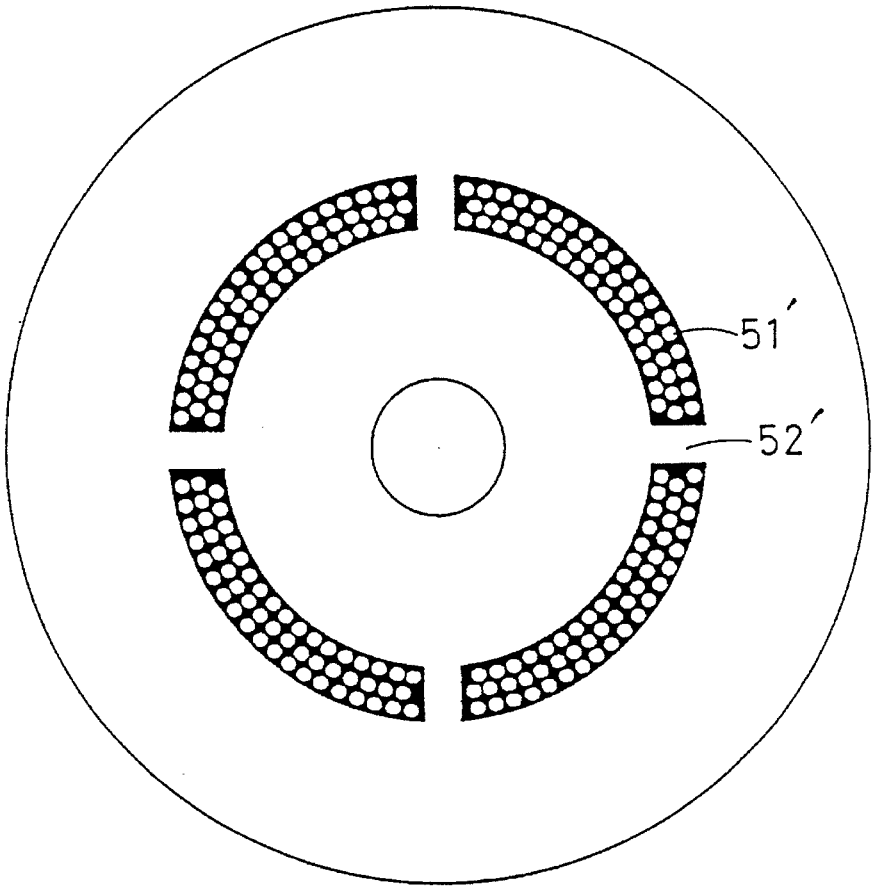
FIG. 9 is an end view of closely arranged thin pulse tube.

Because the thinner pulse tube has higher efficiency, the pulse tube 51', shown in FIG. 9 in a fifth embodiment of the present invention, can be used instead of the pulse tube 2' shown having an FIG. 8. That is, the pulse tube in extremely small diameter in FIG. 9 is closely arranged in a circular ring and corresponds to the width of the circular ring and to the diameter of the high pressure gas inlet and low pressure gas outlet hole. This means fitting the pulse tube in FIG. 9 in the circular area occupied primarily by the wider pulse tube. The diameter of this type of the pulse tube can be thin as 1 to 4 mm. There is linkage rib 52' in the circular ring.

To make the above rotary pulse tube refrigerator of the fourth embodiment, it can be acceptable that the reservoir and valve core is fixed, while the series of pulse tube turn, or that the pulse tubes if fixed, while the reservoir and valve core turn. If there is relative revolution, the principle and structure of the former is similar to the later, so we do not repeat here.

The bearings 24' and 25' of the above EXAMPLE 4 can be replaced by electronic magnetic bearings, thus, the oil pollution problem can be solved. If the position of holes of the high pressure gas inlet, low pressure gas outlet and the holes of each reservoir is changed, the G-M cycle can be realized.

Since the gas flows of the above fourth embodiment into each of the pulse tube successively in the rotary pulse tube refrigerator, the refrigerator keep the condition of continuous gas flow in and continuous expansion. Compared with the single pulse tube, the refrigeration power is increased because the gas inlet is continuous. The slide opening and closing between the hole of high pressure gas inlet holes, low pressure gas outlet holes and the holes of each reservoir decrease the void volume, which increases the pulse tube refrigeration efficiency. Many pulse tubes share the same reservoir and rotary valve core, which increases the volume not so much, because the size of pulse tube is less than that of the heat separator greatly, and also realized a handy size. The gas inlet velocity of pulse tubes is much lower than that in heat separator. This is very suitable for the requirement of the refrigeration power in many case, which can increase the choice of refrigeration power for use. The noise of pulse tube refrigeration is low and the theoretical efficiency is 100% so that we can say that this refrigeration has the same advantage of the conventional pulse tube refrigeration and heat separator, but has no other disadvantages of As mentioned above, in this invention, the high and low pressure gas reservoirs (buffer tanks), and open and close valves are installed on the hot end of the pulse tube. Therefore, the timing of opening and closing such valves is linked to opening and closing valves for high and low pressure gas reservoirs at the cold end (gas inlet side), resulting in an excellent refrigerating effect due to adiabatic expansion.

That is, in the pulse tube refrigerator wherein the cold is produced by time-phase displacement with orifice, an irreversible loss is caused when the gas passes through the orifice. However, the refrigeratior in this invention comprising high and low pressure reservoirs, and open and close valves, all the energy can be converted without loss in adiabatic expansion of the gas in the pulse tube, theoretical efficiency is 100%.

In addition, in the refrigerator, wherein middle pressure gas reservoir is added to high and low pressure gas reservoirs, the loss is prevented due to the effect of the middle pressure gas reservoir, even when the pressure differences between high and low pressure is increased.

Furthermore, in the rotary type pulse tube refrigerator, wherein the pulse tubes are arranged in the same circumference, and open and close valves are rotary valves, there is an advantage that the size is small and a large amount of cold can be produced.

Though the structure of this invention is similar to heat separator in some part, but the principle of refrigeration and structure is different largely. The high pressure gas inlet hole in heat separator is nozzle, the velocity of the gas flow into the tube is sound velocity and the refrigeration is caused by shock wave and expansion wave. On the other hand, the refrigeration principle in this invention is volume expansion, it is similar to piston expansion. The high pressure gas inlet hole is gas flow path. The velocity of the high pressure gas flow into the pulse tube is very low, generally path flow velocity is about 10 to 50 m/s. The tube used in heat separator is about 1 to 3 m long, the pulse tube in this invention is only about 10 to 20 m, the theoretical efficiency of this invention is 100% which never can be obtained in heat separator.

What is claimed are:

1. A pulse tube refrigerator, comprising:

a pulse tube;

gas smoothers located at hot and cold ends of said pulse tube;

a high pressure inlet gas valve; and a low pressure outlet gas valve connected to a sum up tube at the cold end of the pulse tube, wherein a high pressure reservoir and a low pressure reservoir are positioned at the hot end of the pulse tube and two direction valves are positioned respectively between the high pressure reservoir, the low pressure reservoir and the pulse tube.

2. The refrigerator according to claim 1, further comprising:

a middle pressure reservoir positioned between the high pressure reservoir and low pressure reservoir; and a valve positioned between said middle pressure reservoir and the hot end of the pulse tube.

3. The refrigerator according to claim 2, wherein the high pressure reservoir, the middle pressure reservoir and the low pressure reservoir each respectively comprise three long loops of tubing, the two ends of each loop of tubing being connected to the hot end of the pulse tube, the refrigerator further comprising three pairs of unidirectional valves, each valve positioned at an end of each loop of tubing for controlling the direction of gas flow in each said loop of tubing.

4. A rotary pulse tube refrigerator, comprising:

a plurality of pulse tubes installed along the circumference of a pulse tube frame;

a rotatable valve core at a cold end of the pulse tubes;

a high pressure gas inlet and a low pressure gas outlet on the valve core along the same circumference with the pulse tubes, which connect with the cold end of the pulse tubes, wherein a moving seal is maintained between the end of the pulse tube frame and the valve core, and wherein a gas reservoir is arranged at a hot end of the pulse tubes.

5. The rotary pulse tube refrigerator according to claim 4, wherein the reservoir includes a high pressure reservoir, a low pressure reservoir or high pressure gas multi-rotary type reservoir, a middle pressure gas multi-rotary type reservoir, a low pressure gas multi-rotary type reservoir, wherein all of the reservoirs have an inlet and an outlet which is connectable with the hot end of pulse tube.

6. The rotary pulse tube refrigerator according to claim 4 or 5 wherein the angle between the high pressure gas inlet and the low pressure gas outlet is 180°.

7. The rotary pulse tube refrigerator according to claim 5 wherein the plurality of the pulse tubes is made by thin pulse tubes closely installed to a circular ring shape, wherein the width of the ring is almost equal to the diameter of the larger high pressure gas inlet and low pressure outlet.

* * * * *